US005347667A

United States Patent [19]

Schwarz et al.

[11] Patent Number: 5,347,667

[45] Date of Patent: Sep. 20, 1994

[54] PROTECTIVE BEACH APPLIANCE

[76] Inventors: Sam Schwarz; Nora Schwarz, both of 8 Givin La., East Northport, N.Y. 11731

[21] Appl. No.: 27,891

[22] Filed: Mar. 8, 1993

[51] Int. Cl.[5] ..... A47G 9/06

[52] U.S. Cl. ..... 5/418; 135/16; 190/2

[58] Field of Search ..... 5/417–420; 135/164; 190/1, 2

[56] References Cited

U.S. PATENT DOCUMENTS

| | | | |
|---|---|---|---|
| 2,010,472 | 8/1935 | Angel | 5/418 |
| 2,533,322 | 12/1950 | Kober | 135/16 |
| 2,898,609 | 8/1959 | Storie | 5/419 |
| 3,176,315 | 4/1965 | Freund | 5/419 |
| 4,068,786 | 1/1978 | Taniguchi | 5/419 |
| 4,194,601 | 3/1980 | Yellin | 5/419 |

FOREIGN PATENT DOCUMENTS

| | | | |
|---|---|---|---|
| 2400873 | 4/1979 | France | 5/417 |

*Primary Examiner*—Alexander Grosz

*Attorney, Agent, or Firm*—Aufrichtig Stein & Aufrichtig

[57] ABSTRACT

A protective appliance for providing protection from the ground and the sun. The protective appliance includes a covering member for covering a portion of the ground, including an opening therein for a shade mechanism provides protection from the sun's rays and has a support end and a protective end. The support end is adapted to removably extend downward through the opening in the covering member and into the ground a sufficient depth to support the shade member in a generally vertical orientation. The shade member provides protection for an object on the covering member from direct exposure to the sun and the covering member provides protection for an object on the covering member from exposure to the ground. In addition, a carrying member is designed to receive each of the elements in a convenient, transportable form.

16 Claims, 4 Drawing Sheets

PROTECTIVE BEACH APPLIANCE

BACKGROUND OF THE INVENTION

This invention is generally directed to a protective beach appliance and in particular to a portable device for protecting a beachgoer from the sun and sand at the beach with an umbrella and blanket assembly which is easily disassembled and transportable.

It is known that beachgoers often bring blankets, towels or sheets of various sizes and shapes to the beach to lay on. In addition, with the current concern about over-exposure to the sun more people are using various products to protect their skin. Many people use sun lotions, sun screens and sun blocks of various degrees. For some people the skin products are not adequate and additional measures such as the use of a beach umbrella is required. Others utilize beach umbrellas to provide an area of shade for perishable items such as food or drink. In addition, infants and children generally require greater protection from the sun than the skin lotions or creams can provide and require the more complete protection provided by a beach umbrella or a roof such as provided by a tent or portable cabana.

One major problem with going to the beach is that beachgoers must generally carry a variety of items from their car to the beach area, which can often be a distance of several hundred yards or even more from the parking lot to the shore line where most beachgoers like to place their belongings. Generally, beachgoers take at least one towel for each person, shoes or sandals, additional clothing to either change into or to supplement the clothing worn, food or drink, music such as either a portable radio or cassette player with headphones or radio/cassette/compact disk player with attached speakers, a cooler for keeping food and beverages cold, children's items such as diapers, wipes and similar items, sun glasses, hats, reading materials, blankets, sheets or towels for sitting or laying on, folding chairs to sit on, recreational items such as balls, flying discs, paddles and games and a beach umbrella to provide shade. Not all beachgoers carry all of the above items but many of the beachgoers travel heavily laden with bags, bundles and other items from their cars to the beach. As a result, there is often a reluctance to bring along blankets and beach umbrellas which can be large, bulky and difficult to carry in addition to the other items.

In addition, even if the beachgoer brings a blanket and an umbrella, the umbrella must be installed next to the blanket and, depending upon the angle of elevation of the sun, more or less of the blanket is covered with the need to move the entire blanket as the sun moves during the day. Due to the inconvenience of moving the blanket, or the umbrella, and on a crowded beach it is often not possible to move the blanket as the sun shifts, the umbrella does not provide necessary shade.

In addition, if the sun is nearly overhead, only a small portion of the umbrella, may be providing shade on top of the blanket or towel which rests on the sand.

Accordingly, there is a need for an improved protective beach appliance which includes a blanket or other ground covering and an umbrella or other shade device which provides good, even shade coverage through a variety of sun positions, is easily transportable and provides an integrated fashion concept.

SUMMARY OF THE INVENTION

Accordingly, it is an object of the invention to provide an improved protective appliance for providing protection from the ground and sun, including a covering member for covering a portion of the ground. The covering member includes an opening mechanism for creating an opening in the covering member and a shade mechanism for providing protection from the sun's rays, the shade mechanism having a first, support end and a second, protection end, the first, support end being adapted to removably extend downwardly through the opening of the covering member and into the ground a sufficient depth to support the shade mechanism in a generally vertical orientation, whereby the shade mechanism provides protection for an object on the covering member from direct exposure to the sun and the covering member provides protection for an object on the covering member from exposure to or to contact with the ground.

Another object of the invention is to provide an improved beach appliance which is transportable.

A further object of the invention is to provide an improved beach appliance including an umbrella and a beach covering where the umbrella extends through an opening approximate the center of the beach covering to provide shade over the center of the beach covering and allow for enhanced coverage of the beach covering as the sun shifts.

Still another object of the invention is to provide an umbrella and beach covering which provides enhanced protection packaged together with a strap for easy carrying from the car to the beach.

Still a further object of the invention is to provide an improved beach appliance including an umbrella and a beach covering through the hole approximate its center in a pouch with a strap or handle for easy carrying.

Still other objects and advantages of the invention will, in part, be obvious and will, in part, be apparent from the specification.

The invention accordingly comprises the features of the construction, combinations of elements, and arrangements of parts which will be exemplified in the constructions hereinafter set forth further, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
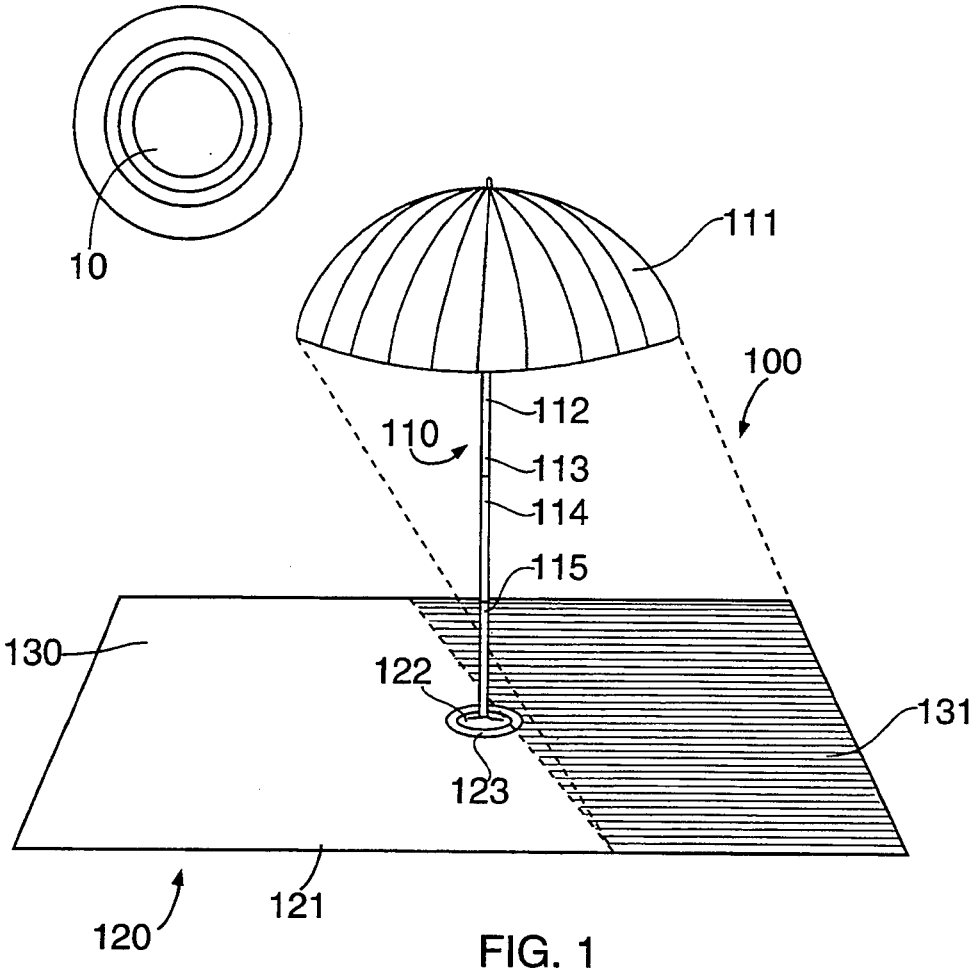
FIG. 1 is a perspective view of the beach appliance constructed in accordance with a preferred embodiment of the invention.

Reference is made to FIG. 1 wherein a beach appliance, generally indicated as 100, constructed in accordance with the first embodiment of the invention, is depicted. Beach appliance 100 includes a beach umbrella, generally indicated as 110, including canopy portion 111 and pole portion 112. In a preferred embodiment, pole portion 112 includes upper pole portion 113 integrally formed with canopy portion 111 and including a mechanism (not shown) for opening and closing canopy portion 111 in accordance with conventional umbrella technology such as retractable ribs. In addition, pole 112 includes an intermediate pole section 114 and bottom portion 115. Fewer or more pieces may form pole 112. In accordance with standard beach umbrella technology, bottom pole portion 115 generally includes a bottom pointed portion 116 (FIG. 2) for easier penetration of the sand or other ground material. Any of the various conventional shapes for the bottom pole member 115 may be utilized. Lower pole portion 115 extends downwardly through beach umbrella assembly 120 including beach blanket 121, opening 122 and protective ring 123. Beach umbrella pole 112 extends downwardly into the sand or other surface material through opening 122 in blanket 121. In FIG. 1, beach umbrella canopy 111 is shown in its opened position and the canopy 111 blocks some of the rays of direct light from the sun 10. As shown in FIG. 1, canopy 111 creates on blanket 121 a shaded region 131 and an unshaded region 130.

Figure 8:
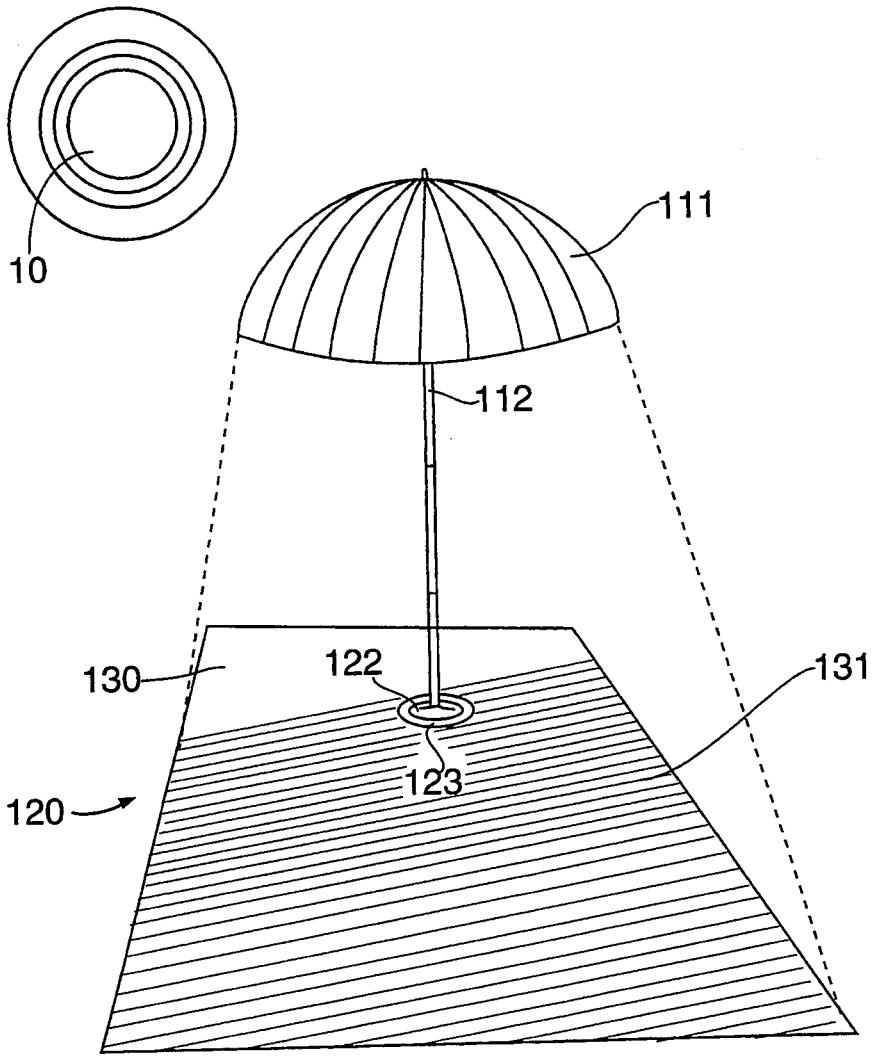
FIG. 8 is a perspective view, similar to FIG. 1, in accordance with the invention.

Reference is next made to FIG. 8 wherein blanket 121 is rotated about beach umbrella pole 112 so as to maximize the shaded region 131. As the sun moves across the sky during the day, the degree of shade provided by umbrella canopy 111 can be maximized by appropriate rotation of blanket 121 about pole 112. Likewise, by rotation, the relative amount of shade can be controlled depending upon the user's interests. Sun worshippers can adjust blanket 121 so that only a small portion of blanket 121 is in the shade to keep food and beverages cool, while the majority of the space is unshaded.

In a preferred embodiment the material of blanket or sheet 121 is formed from a similar material and of a similar pattern as the material of canopy 111 to provide a complimentary and matched appearance. By use of the same materials the cost of manufacture can be, likewise, reduced. Blanket 121 is shown in the figures as rectangular, but it can be round, oval or any desired shape.

Figure 4:
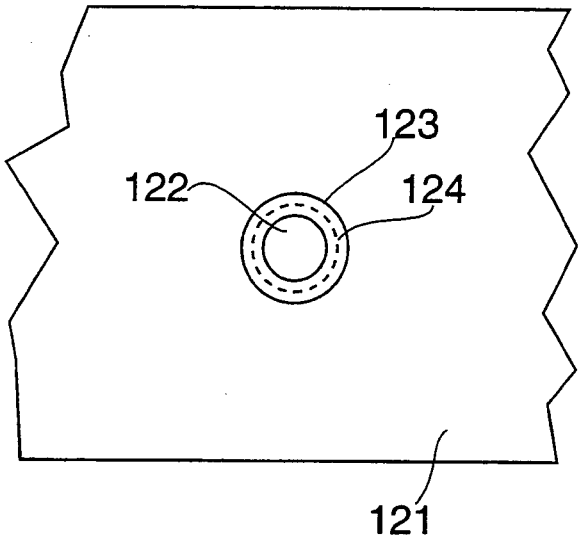
FIG. 4 is a partial top plan view of the beach covering member shown in FIG. 1 in accordance with a preferred embodiment of the invention.
Figure 5:
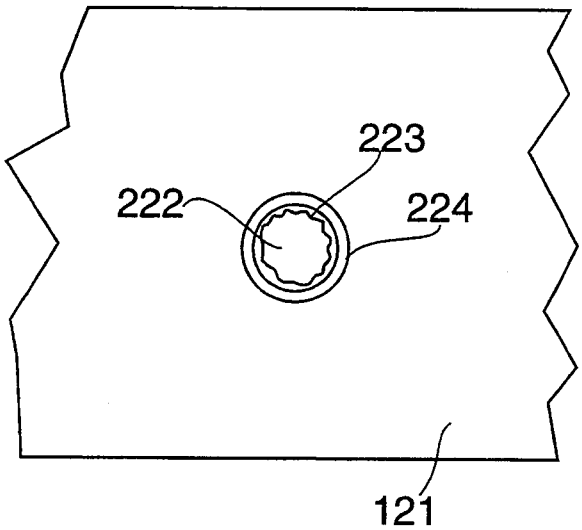
FIG. 5 is a partial top plan view similar to FIG. 4 in accordance with another preferred embodiment of the invention.
Figure 6:
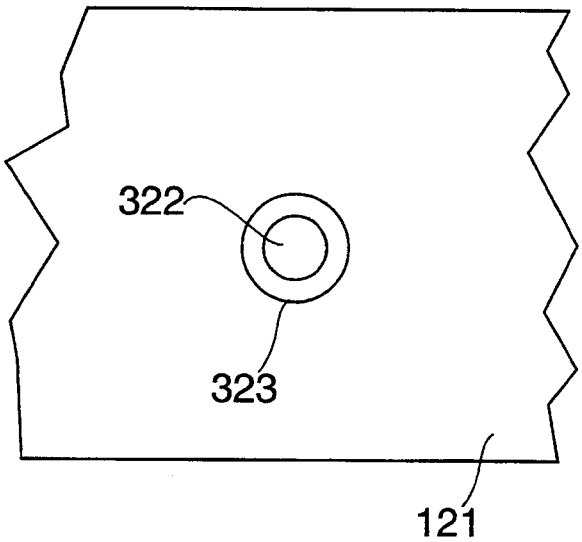
FIG. 6 is a partial top plan view similar to FIG. 4 in accordance with a further preferred embodiment of the invention.

Reference is next made to FIGS. 4, 5 and 6 wherein three separate embodiments of the pole receiving opening 122 in blanket 121 are depicted. Like elements are represented by like reference numerals. In FIG. 4, opening 122 in blanket 121 is surrounded by a fabric ring 123 sewn in place by stitching 124. Opening 122 is thus strengthened to prevent ripping during continued use and to enable easier rotation of blanket 121 about pole 112 in actual use. In a preferred embodiment there is a snug fit between pole 112 and the edge of opening 122.

In the embodiment of FIG. 5, blanket 121 has an opening 222 formed by a ring member 224 including an elastic member secured about the inner periphery of member 224 to form a gathered opening 222. With gathered opening 222, pole 112 is gripped by opening 222 to form a close seal about pole 112 and prevent sand, insects or other materials underneath blanket 121 from entering through opening 222.

The embodiment of FIG. 6 includes an opening 322 in blanket 121 which is ringed by a metal or plastic ring 323 which provides for a strengthened opening about opening 322. Ring 323 may be sized so as to snugly fit around pole 112 or provide a loose fitting.

Various other materials can be used to provide a looser or tighter fit around pole 112 depending upon the expected use of the assembly.

Generally, in a preferred embodiment, blanket or sheet 121 is formed of a light weight cotton, polyester, wool or other natural or synthetic sheet material of suitable size. In addition, beach umbrella 110 can be formed in a variety of sizes and shapes depending upon the intended use. Where the beach appliance is to be used by a single individual, both blanket 121 and umbrella 110 would be made smaller. Likewise, if a family sized beach appliance is desired both blanket 121 and umbrella 110 would be formed in larger sizes.

Figure 2:
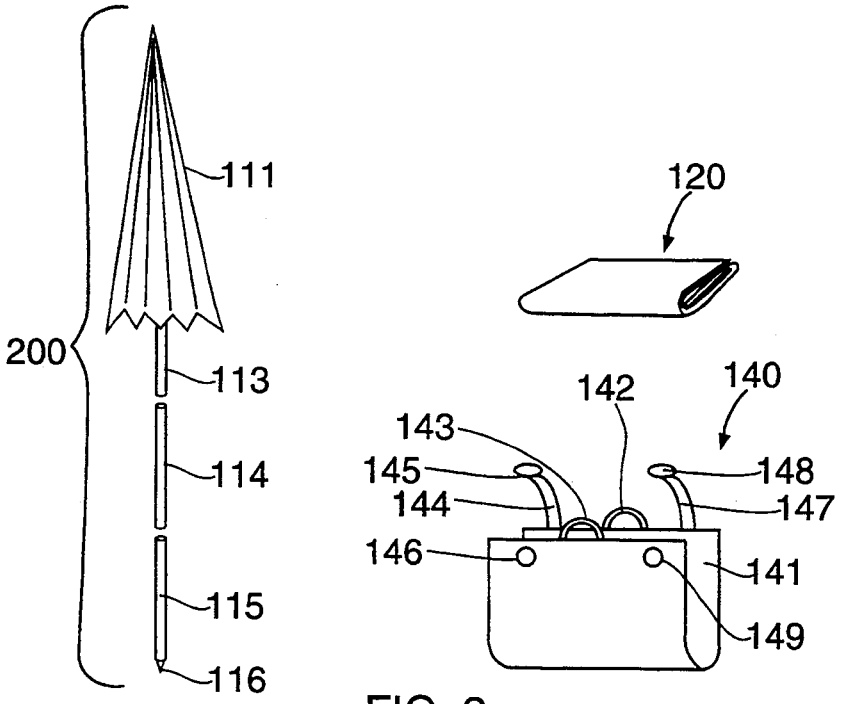
FIG. 2 is an exploded top plan view of a protective beach appliance in accordance with another preferred embodiment of the invention;.
Figure 3:
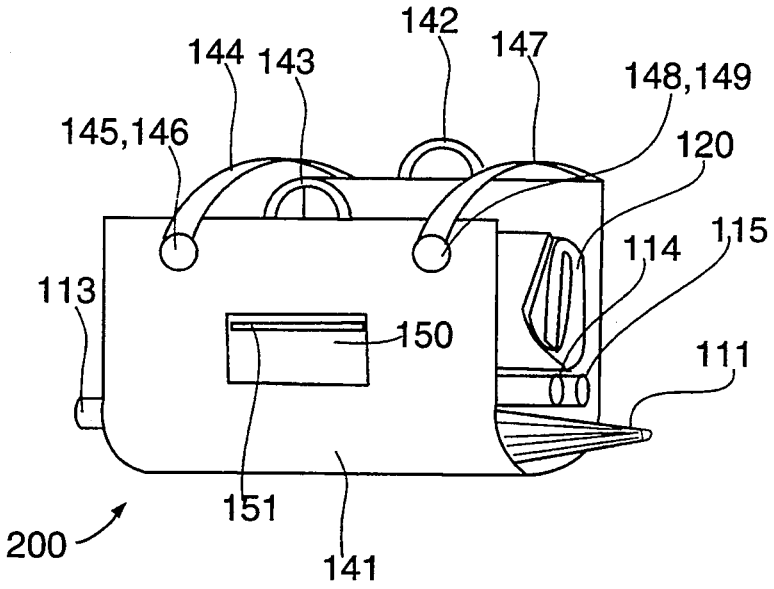
FIG. 3 is a perspective view of the protective beach appliance of FIG. 2 in an assembled form.

Reference is next made to FIGS. 2 and 3 wherein a protective beach assembly, generally indicated as 200, constructed in accordance with another preferred embodiment of the invention, is depicted, like reference numerals correspond to like elements. As shown in FIG. 2, beach appliance 200 includes an upper umbrella portion 113 including canopy portion 111, an intermediate umbrella portion 114 and a lower umbrella portion 115 with pointed tip 116. In addition, blanket assembly 120, shown in a folded state, is included. In addition, a carrying member 140 including satchel member 141, handles 142, 143, securing straps 144, 147 and closure members 145, 146 and 148, 149 is present. While FIG. 2 shows the various elements in beach appliance 200 in an unassembled condition, FIG. 3 shows the same elements secured for transportation within carry-all 141.

In a preferred embodiment of the invention, carry-all 141 is formed of the same material, or at least with a material having similar characteristics and appearance as canopy 111 and blanket 120. In a preferred embodiment of the invention carry-all is formed as a single flexible sheet with handles 142 and 143 on each end. The various components of the umbrella 110 and blanket 121 are stacked within carry-all 141 and securing straps 144 and 147 are deployed by utilizing connectors 145, 146 and 148, 149 to maintain the beach appliance 200 in a neatly transportable form as shown in FIG. 3. In a preferred embodiment, connectors 145, 146 and 148, 149 can be mating hook and pile fasteners, snaps, button and hook loop fasteners or the like. As shown in FIG. 3, the various portions of umbrella 110 fit neatly in carry-all 141. Carry-all 141 may also be formed out of a transparent plastic material so that the various components can be more easily observed.

In a preferred embodiment, carry-all 141 includes a pocket 150, closable by zipper 151. Pocket 150 is useful for storing keys, wallets, watches or similar valuables which may be removed while at the beach or similar recreational area. Pocket 150 can be enlarged to make room for such common beach items as portable radio and cassette players and headphones.

Figure 7:
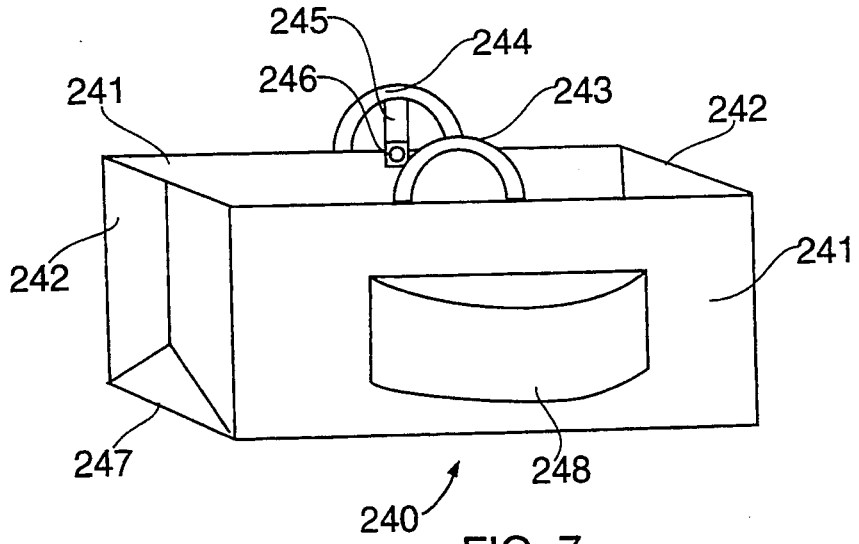
FIG. 7 is a perspective view of a carrier member utilized in accordance with another embodiment of the invention.

Reference is next made to FIG. 7 wherein a satchel 240 constructed in accordance with another preferred embodiment of the invention is depicted. Satchel 240 is formed of front and back wall members 241, side wall panels 242 and bottom panel 247. Panels 241, 242 and 247 are secured by sewing, gluing, heat sealing or other conventional method, dependent upon the material utilized. Satchel 240 also includes a pocket 248, handles 243, 244 and a strap 245 for securing handles 243, 244 together with connectors 246 found on both surfaces of strap 245. The drawing in FIG. 1 only shows a single connector 246 on one side surface of strap 245. The second connector (not shown) is found on the reverse side of strap 245 in accordance with conventional securing technology. The various components shown in FIG. 3 may be likewise placed within satchel 240 rather than carry-all 141. In addition, because of the closed nature of satchel 240, additional items such as food stuffs, clothing, portable audio equipment or recreational equipment can also be carried conveniently together.

The beach appliance of FIGS. 1–8 provides for a highly advantageous form of protection at the beach or other outdoor locations where extended contact with the sun will be had. As the dangers of overexposure to the sun continue to be found, more and more attention has been paid to ways to enjoy outdoor activities without jeopardizing the health of people's skin. Even with the various skin protection creams and lotions, there is a great need for a shade providing device at the beach and similar areas which is convenient, functionally able to provide substantial shade over a period of time as the sun moves and which is easily transportable to and from the beach or other recreational area.

Opening 122 in blanket 121 is shown as generally proximate the center of blanket 121 in FIG. 1. It may be placed closer to one of the ends as shown in FIG. 8, depending upon the intended use.

Traditional beach umbrella systems required the placement of the blanket next to the beach umbrella and required a complicated movement of both the umbrella and the blanket as the sun moves across the sky during the day. The beach appliance 100 constructed in accordance with a preferred embodiment of the invention provides for a simple incremental change in the positioning of blanket 121 as the sun moves to maintain more or less shade area on blanket 121. In this way, if a beachgoer desires to receive more sun and merely keep his food and other belongings in the shade, the blanket 121 may be rotated so as to minimize the shady area 131 and maximize sunny area 130. Particularly when infants are at the beach, it is important to keep them constantly out of the direct sunlight. By placement of opening 122 near the center of the blanket 121, in addition to restricting direct sunlight from contacting infant's skin, the indirect reflection of the sun from a nearby sand or other reflective ground materials can be reduced.

Accordingly, an improved beach appliance which presents improved protection from the sun and ease of adjustment as the sun moves across the sky is provided. In addition, in accordance with another preferred embodiment of the invention, the beach appliance can be easily transported to and from the area of use in a carry-all or satchel. In addition, various forms of securing member about the opening in the blanket can strengthen the opening and prevent the entry of sand or other foreign matter onto the blanket from the underlying surface.

It will thus seem that the objects set forth above among those made apparent from the proceeding description, are efficiently obtained and, since certain changes may be made in the above constructions without departing from the spirit and scope of the invention, it is intended that all matters contained in the above description or shown in the accompanying drawings shall be interpreted as illustrative and not in any limiting sense.

It is also to be understood that the following claims are intended to cover all of the general and specific features of the invention herein described and all statements of the scope of the invention, which, as a matter of language, might be said to fall there between.

What is claimed is:

1. A protective appliance, for providing protection from the ground and the sun, said protective appliance comprising:

covering means, for covering a portion of the ground, said covering means including opening means for creating an opening in the covering means;

shade means for providing protection from the sun's rays, said shade means having a first, support end and a second, protection end, the first, support end being adapted to removable extend downwardly through the opening in the covering means and into the ground a sufficient depth to support the shade means in a generally vertical orientation, the opening means further including constricting means for restricting the size of the opening and biasing the opening means against the portion of the support end of the shade means passing through the opening;

whereby the shade means provides protection for an object on the covering means from direct exposure to the sun and the covering means provides protection for an object on the covering means from exposure to the ground.

2. The protective appliance of claim 1 wherein the constricting means is formed as an elastic member sewn to the covering means proximate and around the opening.

3. The protective appliance of claim 2 wherein the constricting means further includes a finishing member coupled to the covering means about the periphery of the opening and forming the contact with the support end of the shade means.

4. The protective appliance of claim 3 wherein the finishing member is adapted to strengthen the opening and provide a firm fit to the support end of the shade means.

5. The protective appliance of claim 4 wherein the covering means is generally rectangular in shape and is rotatable about the support end of the shade means to adjust the portion of the covering means protected from the sun as the sun moves during a day.

6. The protective appliance of claim 4 wherein the covering means is quadrilateral in shape and is rotatable about the support end of the shade means to adjust the portion of the covering means protected from the sun as the sun moves during a day.

7. The protective appliance of claim 1 further comprising binding means for securing the covering means to the shade means for transportation purposes.

8. The protective appliance of claim 1 wherein the shade means includes an umbrella, having a pole as the first, support means and a collapsible cover acting as the shade portion.

9. A portable protective appliance, for providing protection from the ground and the sun, said protective appliance comprising:

covering means, for covering a portion of the ground, said covering means including opening means for creating an opening in the covering means, the covering means adapted to be converted from an expanded deployed shape, to a smaller, contracted movable shape;

shade means for providing protection from the sun's rays, said shade means having a first, support end and a second, protection end, the first, support end being adapted to removably extend downwardly through the opening in the covering means and into the ground a sufficient depth to support the shade means in a generally vertical orientation, the shade means being movable between a first, expanded shape in which the protection end provides a larger amount of shade and a second contracted shape in which the protection end provides a lesser amount of shade, the opening means further including constricting means for restricting the size of the opening and biasing the opening means against the portion of the support end of the shade means passing through the opening; and carrying means adapted to secure and carry the separated covering means in its movable shape and the shade means in its contracted shape;

whereby the shade means provides protection for an object on the covering means from direct exposure to the sun and the covering means provides protection for an object on the covering means from exposure to the ground and the portable protective appliance can be carried from a place of use by disassembling the covering means and the shade means, placing the covering means in its contracted movable shape and the shade means in its contracted shape and then securing them together for convenient portability with the carrying means and carried to a new place of use in the carrying means to be assembled at the new place of use.

10. The portable protective appliance of claim 9 wherein the carrying means includes handle means for carrying the portable protective appliance and sack means for enclosing the shade means and covering means.

11. The portable protective appliance of claim 9 wherein the carrying means includes handle means for carrying the portable protective appliance and binding means for securely coupling the shade means and covering means.

12. The portable protective appliance of claim 9 wherein the shade means includes at least two separable pieces, a first piece including the covering end and a portion of a support member and a second piece forming the support end and a portion of the support member, the support end being formed at the end of the support member opposite from the covering end.

13. The portable protective appliance of claim 12 wherein the two pieces of the shade means are separated when the portable protective appliance is placed in the carrying means and reassembled when the portable protective appliance is intended to be used.

14. The protective appliance of claim 9 wherein the shade means includes an umbrella, having a pole as the first, support means and a collapsible canopy acting as the shade portion.

15. The protective appliance of claim 14 wherein the collapsible canopy and the covering means are formed of the same material.

16. The protective appliance of claim 15 wherein the carrying means is formed of the same material as the collapsible cover and the covering means.

* * * * *